United States Patent [19]

Mele et al.

[11] Patent Number: 4,999,603

[45] Date of Patent: Mar. 12, 1991

[54] MULTI-FUNCTIONAL BASKETBALL GAME MONITORING UNIT

[76] Inventors: Thomas C. Mele; Mary K. Mele, both of 4804 Palisade Dr.; Robert C. Dyer; Margaret A. Dyer, both of 4806 Palisade Dr., all of Austin, Tex. 78731

[21] Appl. No.: 435,036

[22] Filed: Nov. 13, 1989

Related U.S. Application Data

[63] Continuation-in-part of Ser. No. 293,703, Jan. 5, 1989.

[51] Int. Cl.[5] ..... A63B 63/00; G08B 23/00

[52] U.S. Cl. ..... 340/323 R; 273/1.5 R; 273/371; 364/410; 364/411

[58] Field of Search ..... 340/323 R; 273/1.5 R, 273/371; 364/410, 411; 434/248

[56] References Cited

U.S. PATENT DOCUMENTS

| | | | |
|---|---|---|---|
| 3,868,671 | 2/1975 | Maquire | 273/1.5 R |
| 4,013,292 | 4/1977 | Cohen et al. | 273/371 |
| 4,062,008 | 12/1977 | Carlsson | 340/323 R |
| 4,855,711 | 8/1989 | Harrop et al. | 340/323 R |
| 4,858,920 | 8/1989 | Best | 273/371 |

FOREIGN PATENT DOCUMENTS

| | | | |
|---|---|---|---|
| 1021369 | 12/1977 | Canada | 273/1.5 R |

*Primary Examiner*—Joseph A. Orsino
*Assistant Examiner*—Kinfe-Michael Negash
*Attorney, Agent, or Firm*—Joseph F. Long

[57] ABSTRACT

A multifunctional basketball game monitoring unit that allows automatic scoring taking into account foul shots, and position sensitive shots and also allows scoring of shots missed with a programmable control processing unit allowing for a great variety of differing output statistics both to visual display and to a printer and also allowing a variety of audio choices as programmed or as entered on a keyboard to the controller.

10 Claims, 1 Drawing Sheet

MULTI-FUNCTIONAL BASKETBALL GAME MONITORING UNIT

BACKGROUND OF THE INVENTION

This is a continuation-in-part of Ser. No. 07/293,703, filed Jan. 5, 1989, entitled A Multi-functional Basketball Game Monitoring Unit.

The concept has been further developed to allow automatic scoring of a basketball game played on a full sized court taking into account misses and near misses and adjusting the score for position sensitive shots Use of a programmable central processing unit allows outputting to display the score and many various game statistics as well as programming for a large variety of special sound effects. The unit may be used for score keeping for normal game, practice of foul shots, practice of long shots, etc. with print out records. The unit may then be used both as a training guide and also for normal scorekeeping while allowing a great variety of displays or audio choices. Although there are a variety of scorekeeping, sound effect systems, we do not find any wherein the near misses and a position sensitive shots can be automatically scored.

SUMMARY OF THE INVENTION

The invention comprises the following major components:

(a) a sensor such as an infra-red sensor with a broadcast output to indicate when the basketball passes through the hoop;

(b) a receiver to pick up the broadcast output and feed the data to a central processing unit;

(c) an impact sensor to determine when a basketball strikes said backboard with central processing unit being programmed to count the impact either as a miss or score depending upon the scoring sensor input;

(d) a co-ordinate sensing means which may be a laser beam grid with lines closer together than the diameter of a basketball With input from the laser beam grid the central processing unit may determine position wherein a basketball passes through the laser beam grid and with proper programming can determine location of a spot from whence the shot was thrown;

(e) visual display output from the central processing unit may encompass a wide variety of displays;

(f) keyboard input to the central processing unit provides great flexibility in programming the central processing unit for various record keeping and outputs to a visual display or to activate audio units.

Various other sensors such as banked photoelectric cells, a switch on the ring of the hoop, a capacitance sensor, a laser beam sensor, etc., could be used to determine when the basketball goes through the hoop. Also, the impact sensor could be replaced with other sensors such as proximity sensors, photoelectric cell bank, etc. In the same way the laser beam grid could possibly be replaced with a photoelectric cell grid. All such sensors would come within the spirit and purpose of this invention.

DETAILED DESCRIPTION OF THE INVENTION

Figure 1:
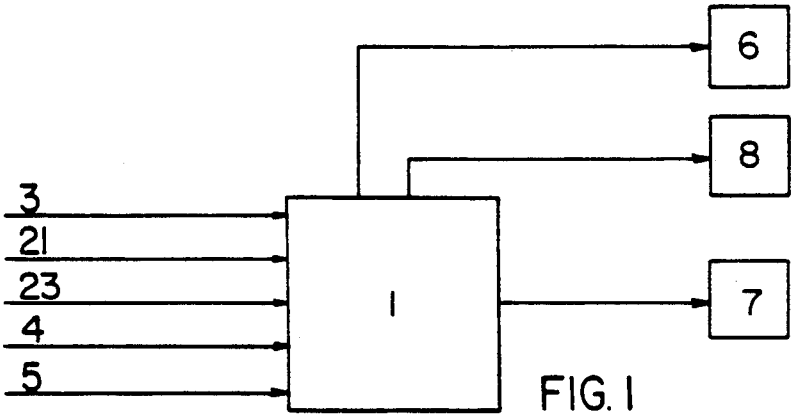
FIG. 1 indicates the component parts and the overall electronic circuitry of the invention.

We will describe a preferred embodiment and other possible variations with a more detailed look at the drawings. Consider first FIG. 1. The programmable central processing unit 1 hereinafter called a controller may receive inputs from cable and/or wireless communication equipment.

The controller 1 receives input from a sensor 3 to determine when a basketball has passed through the hoop. A preferred sensor is an infra-red sensor 3 that may communicate with the controller 1 in a wireless manner. This requires an antenna 18, FIG. 3 to broadcast and a receiver communicating with controller 1 to register successful basketball shots. Wireless communication is preferable in some cases, but use of a cable is also feasible. Other type sensors may also be used.

Further input is received from an impact sensor 4 that registers when a basketball strikes the backboard or hoop but this is nullified by the controller if in a very short elapsed time a successful shot is registered by the infra-red sensor. Otherwise the controller registers a shot attempted to use in further calculations. Further input is received from a keyboard and finally input from laser beam receivers 21 and 23, FIG. 2, allows the controller to calculate xy coordinates or the point where the laser beam was broken by a thrown basketball. The laser beams in the grid are close enough together that the basketball will break at last two beams to indicate coordinate of point while passing through the grid. This is a minimum of one beam passing each way across the playing area. The program in the computer determines location by calculation taking into account the trejectory of the ball. Note that if the laser beam grid is close enough in vertical distance to the basketball hoop a particular coordinate could also indicate a basket made. Correction is in the program when using the infra-red sensor to determine when a ball passes through the hoop.

Referring again to FIG. 1, controller 1 sends output to visual display board 7. With inputs as discussed and with a controller having a clock mechanism the visual output could include points made per time interval, total points made points made on foul shot points, points made of three (3) point score, percentage of points made versus points attempted, etc. The controller also has an output to audio 6. This output could enable music, cheers, cartoons, etc., for any of chosen statistics available.

Printer output 8 could be activated by keyboard input or could be programmed to be automatic, printing score, time, other calculated statistics, etc.

Figure 2:
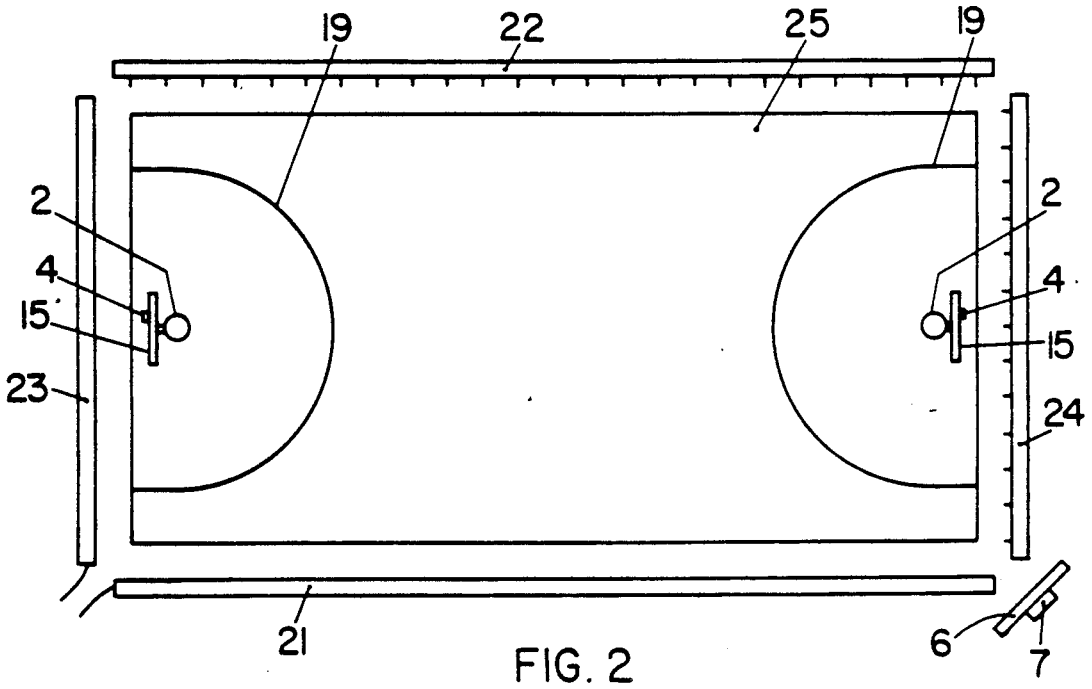
FIG. 2 indicates a possible layout for a laser beam grid that determines with the aid of a microprocessor and proper programming if the shot is attempted from a score sensitive location.

FIG. 2 shows a plan view of a basketball court 25. On each end is shown backboard 15, hoop 2 and impact sensor 4. Visual display unit 7 which may be a scoreboard with audio output 6 is indicated. Laser beam generators 22 and 24 and laser beam receivers 23 and 21 are indicated. Cables from 21 and 23 communicate with the controller 1, FIG. 1. Lines 19 indicate break point between three (3) point shots and two (2) point shots. Determination of when a foul shot is made uses elapsed time to differentiate from a normal in-play shot.

Figure 3:
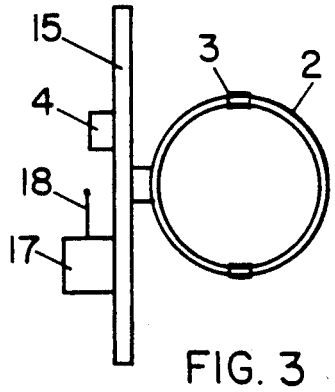
FIG. 3 indicates a plan view of backboard, hoop and an infra-red screening sensor and power unit.

In FIG. 3 we show a plan view of a backboard 15, a hoop 2 with IR detector 3 mounted thereon. Power unit 17 may be furnished power by solar cells, battery or a transformer and rectifier. Antenna 18 may be used for wireless transmission to controller 1 through the receiver, FIG. 1. An impact sensor 4 may be connected to circuitry in Power Unit 17 to communicate via antenna 18 with controller 1. All sensors may communicate with controller 1 with either cable or wireless communication means.

We claim:

1. A multifunctional basketball game monitoring unit comprising:

(a) a scoring sensor means to sense passage of a basketball through a hoop on a backboard;

(b) a power source to power said scoring sensor means and communication means from said scoring sensor means to a controller means;

(c) an impact sensor means to determine when a basketball impact said backboard and to transmit data to said controller means;

(d) laser beam generator means and laser beam receiver means to form a laser beam grid over a playing surface between two of said backboard with beams of said laser beams grid being closer together than a diameter of said basketball;

said laser beam receiver means communicating with said controller means to allow determination of coordinates of a point where said basketball passes through said laser grid;

(e) an output from said controller means to a visual display unit.

2. A multifunctional basketball game monitoring unit as in claim 1 wherein said controller means is programmable from a keyboard.

3. A multifunctional basketball game monitoring unit as in claim 1 wherein said communication means between said scoring sensor means and said controller means is a wireless communication equipment.

4. A multifunctional basketball game monitoring unit as in claim 1 where in said controller means contains a timing circuit and with inputs from said laser beam grid, said impact sensor, and said scoring sensor means calculates and displays to the proper score for foul shots and for other locations sensitive shots.

5. A multifunctional basketball game monitoring unit as in claim 1 wherein said controller means outputs to activate an audio means.

6. A multifunctional basketball game monitoring unit as in claim 1 wherein said controller means stores data and, upon command from a keyboard, will output to a printer.

7. A multifunctional basketball game monitoring unit comprising:

(a) a controller means with associated electronic circuitry that receives input from a scoring sensor means and a coordinate sensing means to respectively determine when a basketball passes through a hoop and to determine a position from whence said basketball was thrown; said controller means acting to calculate statistics relative to inputs from said scoring sensor means, and said coordinate sensing means and to store and display said statistics.

8. A multifunctional basketball game monitoring unit as in claim 7 wherein said controller means receives input from a keyboard and stores and outputs data to a printer.

9. A multifunctional basketball game monitoring unit as in claim 7 wherein said controller means may output to activate audio devices.

10. A multifunctional basketball game monitoring unit as in claim 7 wherein an impact sensing means determines near misses and said controller means may then calculate percentage of baskets made from total baskets attempted.

* * * * *